US008882377B2

(12) United States Patent
Kim

(10) Patent No.: US 8,882,377 B2
(45) Date of Patent: Nov. 11, 2014

(54) PRINTING MEDIUM FEEDING CASSETTE AND IMAGE FORMING APPARATUS INCLUDING THE SAME

(75) Inventor: Sin-Ae Kim, Hwaseong-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 541 days.

(21) Appl. No.: 12/794,483

(22) Filed: Jun. 4, 2010

(65) Prior Publication Data

US 2011/0058883 A1 Mar. 10, 2011

(30) Foreign Application Priority Data

Sep. 7, 2009 (KR) ..... 10-2009-0084128

(51) Int. Cl.
*B65H 1/04* (2006.01)
*B65H 1/26* (2006.01)

(52) U.S. Cl.
CPC ..... *B65H 1/266* (2013.01); *B65H 2403/47* (2013.01); *B65H 2511/22* (2013.01); *B65H 2402/515* (2013.01); *B65H 2511/10* (2013.01); *B65H 2511/12* (2013.01)
USPC ..... 400/624; 400/633; 399/393; 271/171

(58) Field of Classification Search
CPC ..... B65H 9/101; B65H 2402/515; B65H 2402/5151; B65H 2402/32; B65H 1/04
USPC ..... 271/171; 400/624, 629, 633; 399/393
See application file for complete search history.

(56) References Cited

U.S. PATENT DOCUMENTS

| | | | | |
|---|---|---|---|---|
| 5,931,456 | A | 8/1999 | Laidlaw | |
| 8,020,855 | B2 | 9/2011 | Kawarago | |
| 8,087,664 | B2 * | 1/2012 | Imai | 271/171 |
| 8,136,809 | B2 * | 3/2012 | Furusawa | 271/171 |
| 8,246,045 | B2 * | 8/2012 | Kubo | 271/171 |
| RE44,135 | E | 4/2013 | Kobayashi | |
| 2008/0001346 | A1 * | 1/2008 | Meetze et al. | 271/171 |
| 2008/0079214 | A1 | 4/2008 | Kawarago | |
| 2009/0295068 | A1 * | 12/2009 | Kubo | 271/18 |
| 2010/0078875 | A1 * | 4/2010 | Nishiyama | 271/127 |

FOREIGN PATENT DOCUMENTS

| | | |
|---|---|---|
| EP | 1821154 | 8/2007 |
| JP | 7-285681 | 10/1995 |
| JP | 11-139573 | 5/1999 |

(Continued)

OTHER PUBLICATIONS

Extended European Search Report dated May 11, 2012 issued in EP Application No. 10167730.0.

(Continued)

*Primary Examiner* — Daniel J Colilla
(74) *Attorney, Agent, or Firm* — Staas & Halsey LLP

(57) ABSTRACT

Disclosed are a printing media holder and an image forming apparatus including the same. The printing media holder includes an printing media alignment unit capable of moving bidirectionally toward and away from the printing media loaded on the printing media holder, and includes a release mechanism that releases the printing media alignment unit, to allow the printing media alignment unit to move its position for aligning of print media of different sizes, in response to a force received thereto in any of the bidirectional directions.

19 Claims, 14 Drawing Sheets

(56) References Cited

FOREIGN PATENT DOCUMENTS

| | | | | | |
|---|---|---|---|---|---|
| JP | 2007-197159 | | | 8/2007 | |
| JP | 2007-223686 | | | 9/2007 | |
| JP | 2007-297148 | | | 11/2007 | |
| JP | 2008-105856 | | | 5/2008 | |
| JP | 2008-196403 | | | 8/2008 | |
| JP | 2009286529 | A | * | 12/2009 | |
| JP | 2010030763 | A | * | 2/2010 | ..... B65H 1/04 |
| KR | 1999-0017166 | | | 5/1999 | |
| KR | 2001-0001037 | | | 1/2001 | |
| KR | 2007-0031538 | | | 3/2007 | |
| KR | 2007-0044704 | | | 4/2007 | |

OTHER PUBLICATIONS

European Office Action dated Apr. 2, 2013 issued in EP Application No. 10167730.0.

Korean Notice of Allowance dated Feb. 19, 2013 issued in KR Application No. 10-2009-0084128.

European Office Action dated Aug. 15, 2013 issued in EP Application No. 10167730.0.

European Oral Proceedings dated Apr. 7, 2014 issued in EP Application No. 10167730.0.

Chinese Office Action dated May 4, 2014 issued in CN Application No. 201010274233.2.

Japanese Office Action dated Mar. 4, 2014 issued in JP Application No. 2010-200222.

* cited by examiner

PRINTING MEDIUM FEEDING CASSETTE AND IMAGE FORMING APPARATUS INCLUDING THE SAME

CROSS-REFERENCE TO RELATED APPLICATIONS

This application claims priority from Korean Patent Application No. 10-2009-0084128, filed on Sep. 7, 2009 in the Korean Intellectual Property Office, the disclosure of which in its entirety is incorporated herein by reference.

TECHNICAL FIELD

The present disclosure relates generally to a printing medium feeding cassette and an image forming apparatus including the same, and more particularly, to a printing medium feeding cassette with an improved convenience and/or efficacy in adjusting the width of printing media loaded thereon, and an image forming apparatus including the same.

BACKGROUND OF RELATED ART

An image forming apparatus for forming a desired image on a printing medium may employ various types of image forming methods, including for example the inkjet type, thermal transfer type or the electro-photographic type.

Regardless of the type actually being used, an image forming apparatus includes an image forming part that forms the image on a printing medium and a printing medium feeding cassette that feeds the printing medium to the printing forming part.

Such printing medium feeding cassette is typically equipped with an adjustable aligning unit for aligning and guiding edge(s) of the printing media loaded thereon so as to avoid skewing of the printing medium as it is picked up or fed. By adjusting the position of the aligning unit, typically by a user either pulling or pushing on a handle provided in the aligning unit, it is possible to ling and guide printing media of varying sizes for proper feeding.

However, in a conventional aligning unit adjustable by only one of the pulling and pushing on the handle, if the user manipulates such handle in the wrong direction, the aligning unit cannot be properly positioned, and may even become damaged.

SUMMARY OF DISCLOSURE

According to an aspect of the present disclosure, a printing medium feeding cassette for accommodating printing media for use in an image forming apparatus may be provided to include a cassette body, a knock-up plate and an aligning unit. The cassette body may have arranged therein a body hook formed along an adjustment direction, which may be any one of a width direction and a length direction of the printing media. The knock-up plate may be supported in the cassette body, and may have a surface for supporting thereon the printing media. The aligning unit may be supported on the cassette body for aligning the printing media loaded on the knock-up plate, and may include a unit body movable along the adjustment direction, a unit hook configured to selectively come into an engaging contact with the body hook and a hook releaser coupled to the unit body. The hook releaser may be configured to receive an external force and to cause the unit hook to be released from the body hook in response to the external force received in each of a pulling direction and a pushing direction.

The hook releaser may be configured to cause the unit hook to move to one of first and second released positions, at each of which positions the unit hook is released from the body hook, when the external force is exerted on the hook releaser, and cause the unit hook to be in an engaged position, at which position the unit hook is engaged with the body hook, when the external force is released from the hook releaser.

The printing medium feeding cassette may further comprise an elastic member that elastically biases the unit hook such that the unit hook returns to the engaged position when the external force is released.

One of the unit hook and the hook releaser may include a projection projecting toward the other one of the unit hook and the hook releaser. The other one of the unit hook and the hook releaser may include a guide which guides movement of the projection.

The guide may include a guide groove configured to guide the movement of the projection between the first released position, the engaged position and the second released position.

The hook releaser may be rotatably coupled to the unit body. The unit hook may approach the rotational center of the hook releaser to move to the first and second released positions, and may move away from the rotational center to move to the engaged position.

The unit hook may alternatively reciprocates linearly.

The rotational center of the hook releaser may be located on a plane along which the unit hook linearly moves.

The hook releaser may be coupled to the unit body such that the hook releaser reciprocates slidably along the adjustment direction with respect to a sliding motion center. The unit hook may approach the sliding motion center to move to the first and second released positions, and may move away from the sliding motion center to move to the engaged position.

The body hook may include a rack which is provided along the adjustment direction.

The hook releaser may include an external force receiving portion configured to receive the external force. An end portion of the external force receiving portion may be outwardly inclined with respect to a sagittal center of the hook releaser.

According to another aspect of the present disclosure, an image forming apparatus may be provided to include a body, a printing medium feeding cassette, a knock-up plate and an aligning unit. The printing medium feeding cassette may be detachably received in the body of the image forming apparatus, and may comprise a cassette body, a knock-up plate and an aligning unit. The cassette body may have arranged therein a body hook formed along an adjustment direction, which may be any one of a width direction and a length direction of the printing media. The knock-up plate may be supported in the cassette body, and may have a surface for supporting thereon the printing media. The aligning unit may be supported on the cassette body for aligning the printing media loaded on the knock-up plate, and may include a unit body movable along the adjustment direction, a unit hook configured to selectively come into an engaging contact with the body hook and a hook releaser coupled to the unit body. The hook releaser may be configured to receive an external force and to cause the unit hook to be released from the body hook in response to the external force received in each of a pulling direction and a pushing direction.

According to yet another aspect of the present disclosure, an apparatus for guiding at least one edge of a printing medium being fed into an image forming apparatus may be provided to include a print media accommodation unit, a contact frame, an engagement member and an engagement releaser member. The print media accommodation unit may have a support surface for placing thereon the printing medium. The contact frame may be moveable in a first adjustment direction toward the at least one edge of the printing medium supported on the support surface and in a second adjustment direction away from the at least one edge of the printing medium. The engagement member may be configured to selectively engage with a portion of the print media accommodation unit to thereby restrict the movement of the contact frame. The engagement releaser member may be coupled to the engagement member, and may be configured to cause the engagement member to be released from the portion of the print media accommodation unit in response to an external force received in the first adjustment direction and in the second adjustment direction.

The engagement releaser member may be configured to move in response to the received external force, and may have formed thereon a guide that guides the engagement member to move along a direction substantially perpendicular to the first and second adjustment directions during when the engagement releaser member moves in response to the received external force.

The engagement releaser member may be configured to pivot about a rotational axis in response to the received external force.

The engagement releaser member is configured to slide linearly along a direction substantially parallel to the first and second adjustment directions in response to the received external force.

The portion of the print media accommodation unit may comprise a rack having a plurality of teeth arranged along a direction substantially parallel to the first and second adjustment directions. The engagement member may comprise a unit hook having formed on an end thereof one or more engagement teeth for engaging with one or more of the plurality of teeth of the rack.

The engagement releaser member may comprise an external force receiving portion through which the external force is received. The external force receiving portion may be at an incline with respect to a line perpendicular to the first and second adjustment directions.

The apparatus may further comprise an elastic member elastically biasing the engagement member toward a direction positioning the engagement member to be engaged with the portion of the print media accommodation unit.

The engagement releaser member and the contact frame are coupled to each other in such a manner that the external force received by the engagement releaser member causes both the engagement release member and the contact frame to move together in one of the first and second adjustment directions.

BRIEF DESCRIPTION OF THE DRAWINGS

Various aspects and features of the present disclosure will become apparent and more readily appreciated from the following description of several embodiments thereof, taken in conjunction with the accompanying drawings, in which.

DETAILED DESCRIPTION OF SEVERAL EMBODIMENTS

Figure 1:
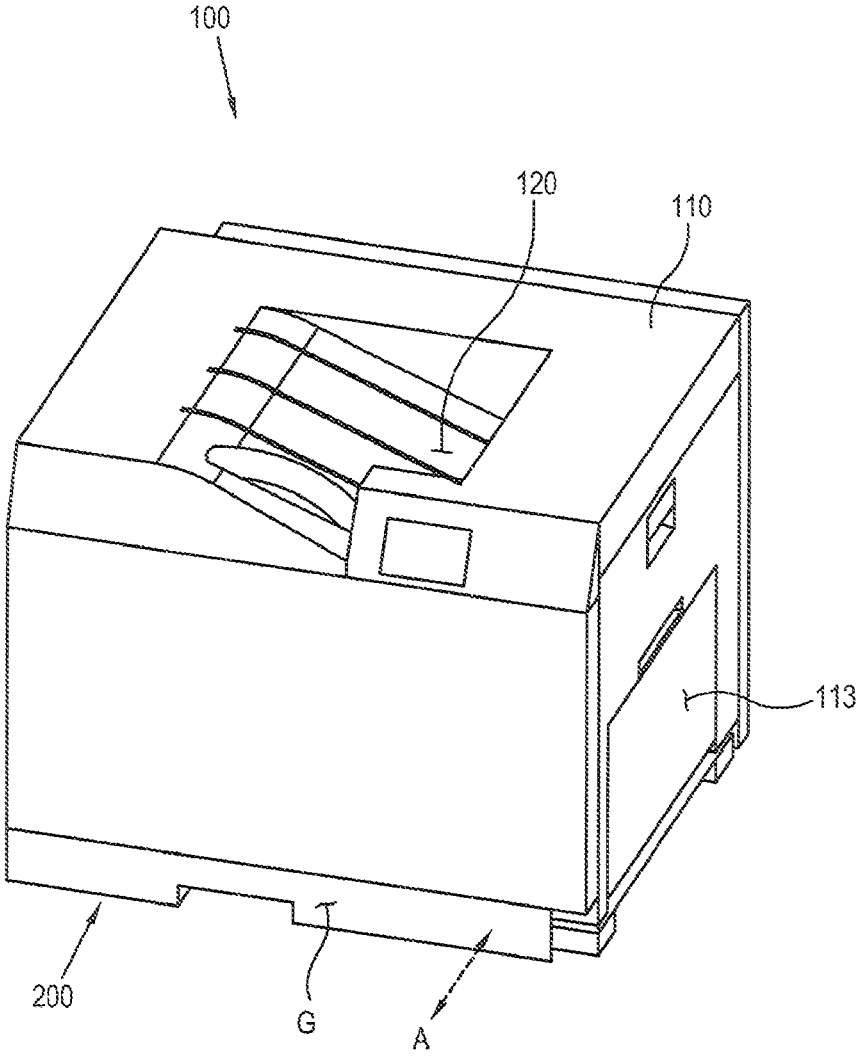
FIG. 1 is a schematic perspective view of an image forming apparatus according to an embodiment of the present disclosure.

Reference will now be made in detail to the embodiments of the present disclosure, examples of which are illustrated in the accompanying drawings so as to enable those skilled in the art to practice the teachings of the present disclosure. The scope of the present disclosure however is not limited to those embodiment disclosed herein, but may be implemented in various and different other configuration, arrangement and forms.

In the following description, for clarity sake, the same components or features incorporated in various embodiments are denoted by the same reference numerals throughout the drawings, and descriptions thereof may not be repetitively given.

Figure 2:
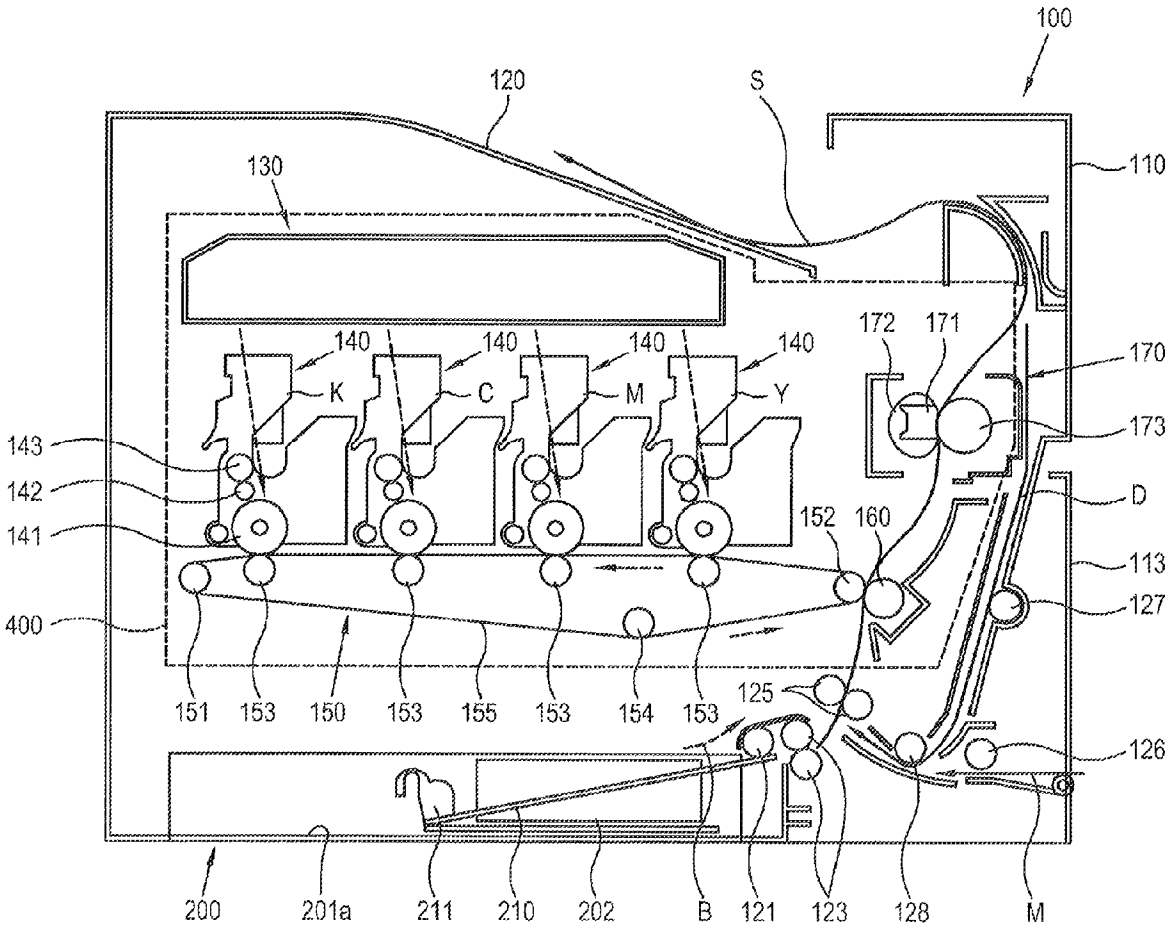
FIG. 2 is a cross-sectional view of the image forming apparatus of FIG. 1.

As shown in FIGS. 1 and 2, an image forming apparatus 100 according to an embodiment of the present disclosure may include a body 110, a printing medium feeding cassette 200 that may be detachably supported in the body 110 and an image forming part 400 for forming an image on a printing medium fed from the printing medium feeding cassette 200. While, for brevity sake, and as an illustrative example, the image forming apparatus 100 will be described as including an image forming part 400 implements electro-photographic type of image forming, it should be understood by and apparent to those skilled in the art that other types of image forming process such as, for example, inkjet or thermal printing method, may be practiced by the image forming part 400.

The printing media loaded on the printing medium feeding cassette 200 may be picked up by a pickup roller 121 installed within the body 110.

A multi-feeding prevention unit 123 may also be provided to prevent the simultaneous feeding of multiple sheets of printing media, thereby resulting the picked-up printing media being carried toward the registration roller(s) 125 one sheet at a time.

The registration roller 125 may be provided in the body 110, and may align the leading end of the printing medium, and may then provide the printing medium to the image forming part 400 at the proper timing.

As the printing medium passes through the image forming part 400, the desired image is formed on the printing medium, which is then discharged to a discharging part 120.

The image forming part 400 according to an embodiment may include a plurality of developing cartridges 140 respectively storing therein yellow (Y), magenta (M), cyan (C) and black (K) color toners, an exposing unit 130, an intermediate transferring unit 150, a final transferring unit 160 and a fixing unit 170.

Each of the plurality of developing cartridges 140 may include an image receptor (or carrier) 141 for supporting thereon an electrostatic latent image which is formed by exposure to light from the exposing unit 130, a developing roller 142 that develops the electrostatic latent image with toner stored therein to form a visible toner image on the image receptor 141 and a supplying roller 143 that supplies the stored toner to the developing roller 142.

The exposing unit 130 may include, for example, a light source (not shown) emitting a light beam, a bean deflector (not shown) deflecting the light beam emitted by the light source along a main scanning direction and a reflecting mirror (not shown) that reflects the deflected light beam toward the image receptor 141.

The intermediate transferring unit 150 includes an intermediate transfer belt 155 onto which the visible toner image is transferred from the respective image receptors 141 of the plurality of developing cartridges 140, a plurality of intermediate transfer rollers 153 which are arranged to face the respective corresponding image receptors 141 with the intermediate transfer belt 155 interposed therebetween and a plurality of driving rollers 151, 152 and 154 for rotationally driving the intermediate transfer belt 155.

The developing cartridges 140 storing the yellow (Y), magenta (M), cyan (C) and black (K) color toners may be arranged along the rotational path of the intermediate transfer belt 155. As the intermediate transfer belt 155 rotates, the individual yellow (Y), magenta (M), cyan (C) and black (K) color visible toner images formed respectively on the image receptors 141 are transferred onto the intermediate transfer belt 155 in a manner such that the individual color images are superimposed or overlapped on one another. Accordingly, the desired full color image may be formed on the intermediate transfer belt 155 as a superimposed combination of the different color toners (for example, Y, M, C and K).

The full color image on the intermediate transfer belt 155 is finally transferred on to the printing medium fed by the registration roller(s) 125. To that end, the driving roller 152 may be arranged to opposingly face the final transferring unit 160 with the intermediate transfer belt 155 interposed therebetween so as to allow the full color image to be transferred from the intermediate transfer belt 155 onto the printing medium passing through and between the intermediate transfer belt 155 and the transferring unit 160 by, for example, an electrostatic attraction force.

The full color image transferred onto the printing medium may be fixed onto the printing medium by heat and pressure imparted on the printing medium while the printing medium passes through the fixing unit 170.

The fixing unit 170 may include a heater 171 which generates heat, a heating belt 172 that is heated by the heater 171 while rotating around the heater 171 and a press roller 173 opposingly facings the heater 171 with the heating belt 172 interposed therebetween to thereby press the printing medium against the heating belt 172.

The printing medium on which the full color image has been formed after passing through the fixing unit 170 is discharged to the discharging part 120.

While traveling along a single-sided printing path S, one side of the printing medium supplied from the printing medium feeding cassette 200 may be printed according to the processes described above, and upon completion of such single-sided printing may be discharged to the discharging part 120 by one or more discharging rollers (not shown).

For a double-sided printing, the printing medium which passed through the fixing unit 170 may be fed back toward the image forming part 400 by means of the discharging roller(s) (not shown) and the duplex rollers 127 and 128 along the double-sided printing path D. The printing medium with its sides reversed is made to again pass through the registration roller 125, between the intermediate transfer belt 155 and the final transfer belt 160, and through the fixing unit 170, to thereby form another full color image on reverse side of the print medium. The printing medium having the image printed on both sides thereof is then discharged to the discharging part 120, allowing a user to obtain a double-sided printed result.

In addition to the above-described single-sided printing path S and the double-sided printing path D, the image forming apparatus 100 may be supplied with a printing medium along a manual feeding path M. For example, a printing medium may be placed manually on a cover 113 pivoted away from the body 110 so as to be open to allow access to the manual feeding path M provided in the body 110: The manual feeding path M may be arranged to join the single-sided printing path S at the registration roller 125 after passing through a portion of the double-sided printing path D.

The image forming apparatus 100 according to an embodiment may include a manual pickup roller 126 for picking up the printing medium placed on the cover 113. The picked-up printing medium may be then carried toward the registration roller(s) 125 by the duplex roller 128. The printing scheme of the printing medium manually fed is substantially the same as the printing scheme of the printing medium carried along the existing single-sided printing path S, a detailed description thereof is thus not necessary.

Figure 3:
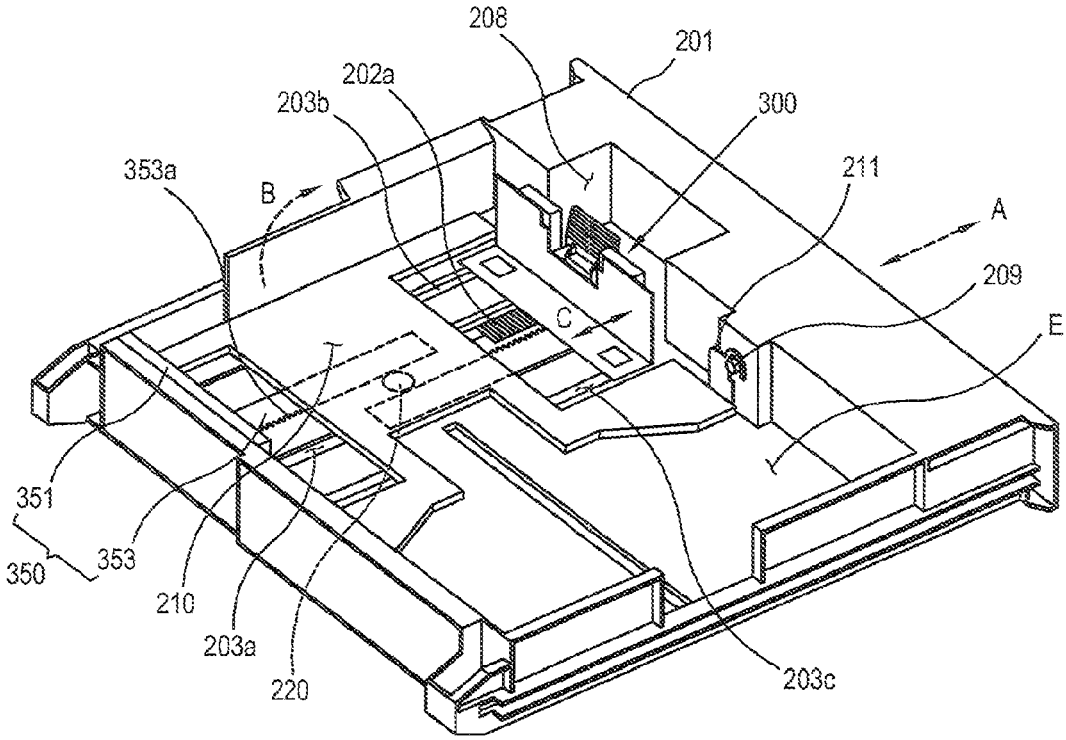
FIG. 3 is an enlarged perspective view of a printing medium feeding cassette of the image forming apparatus of FIG. 1.

As shown in FIGS. 2 and 3, the printing medium feeding cassette 200 may include a cassette body 201 detachably supported in the body 110 of the image forming apparatus 100; a knock-up plate 210 accommodated in the cassette body 201 for supporting thereon the printing media and an aligning unit 300 provided in the cassette body 201 for aligning the printing medium loaded on the knock-up plate 210.

Referring to FIG. 3, the printing medium feeding cassette 200 according to an embodiment may be attached to, and detached from, the body 110 along the direction A that may intersect the direction B along which the printing media loaded on the knock-up plate 210 is supplied. It is to be understood however that in alternative embodiments the attachment/detachment of the printing medium feeding cassette 200 may be made in directions different from the direction A shown in FIG. 3.

The cassette body 201 defines an accommodation space E in which the printing media is accommodated. The cassette body 201 includes a underlying frame 202 (see FIG. 2) disposed within the accommodation space E. The underlying frame 202 may be spaced apart from the inner bottom 201*a* of the cassette body 201 by a predetermined gap.

The underlying frame 202 includes a body hook 202*a* formed along a width direction C of the printing medium. The width direction C of the printing medium is substantially perpendicular to the direction along which the printing medium being supplied travels over a plane parallel to the bottom of the cassette body 201.

Figure 6:
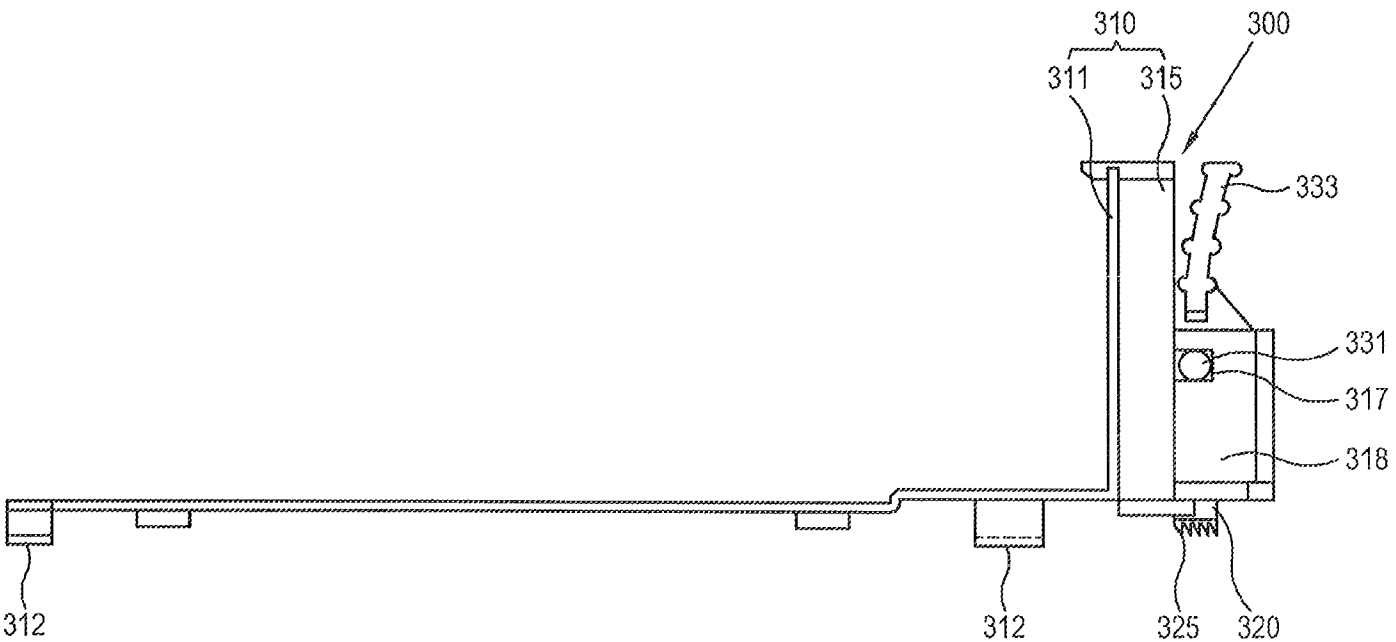
FIG. 6 is a schematic side view of the aligning unit of FIG. 4.
Figure 7:
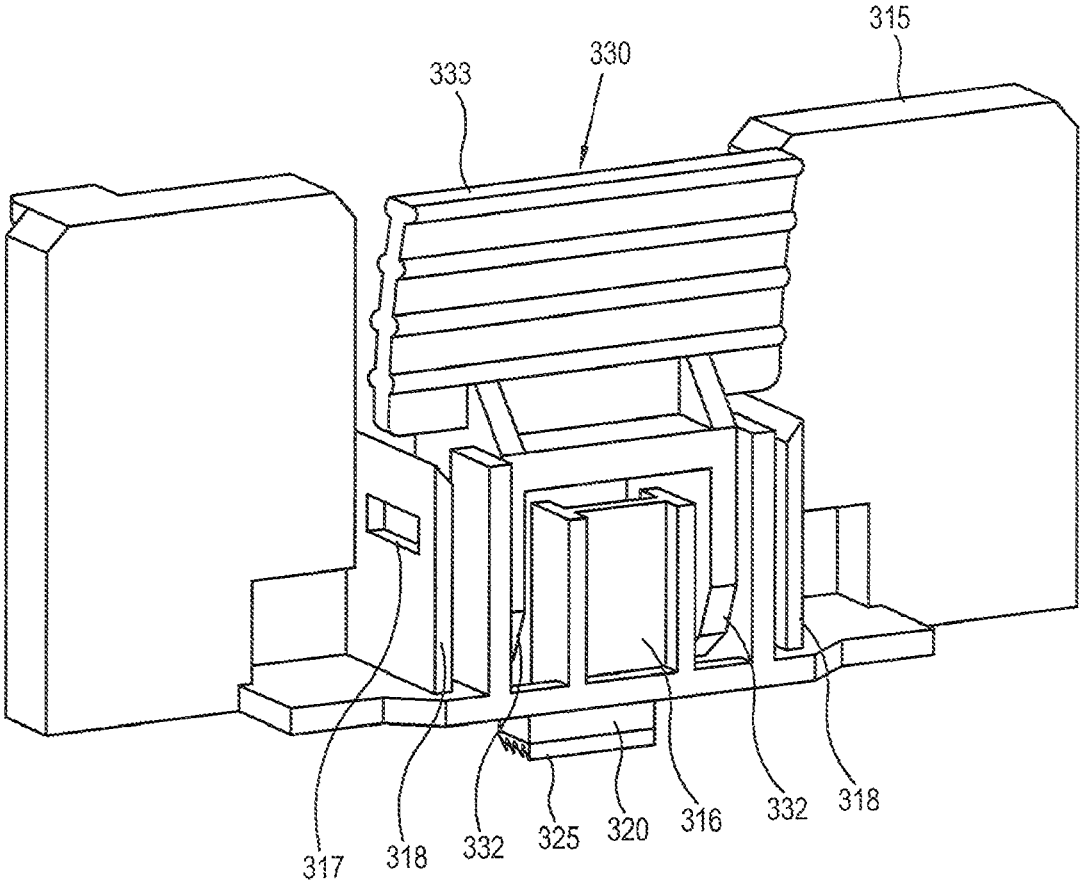
FIG. 7 is an enlarged perspective view of a main portion of the enlarged perspective view of FIG. 5.

The body hook 202*a* may include a rack for regulating the movement of a stopper 325 (shown in FIG. 6) of the aligning unit 300, which will be described later. While as an illustrative example, the shown body hook 202*a* according to an embodiment is shown as a rack in FIG. 3, the body hook 202*a* may be modified in various ways so long as the movement of the stopper 325 of a unit hook 320 (FIG. 6), which will be described later, can be regulated.

The underlying frame 202 may further include a plurality of guide grooves 203*a*, 203*b* and 203*c* formed to extend along the width direction C of the printing medium. The number of the guide grooves 203*a*, 203*b* and 203*c* may be selected to correspond to the number of separation preventers 312 (FIG. 4), which will be described later.

In addition, as shown in FIG. 3, the cassette body 201 may include an aligning unit accommodating space 208 for accommodating the aligning unit 300 when the aligning unit 300 moves to the outermost position in the width direction C of the printing medium.

The knock-up plate 210 includes a supporting portion 211 rotatably supported to a hinge shaft 209 provided in the rear portion of the knock-up plate 210. The front end portion of the knock-up plate 210 (with respect to the printing medium supplying direction B) may be elastically biased toward the pickup roller 121 by an elastic member (not shown).

Referring to FIGS. 4 to 7, the aligning unit 300 according to an embodiment may include a unit body 310; the unit hook 320 and a hook releaser 330.

The unit body 310 supported to the cassette body 201 so as to be movable along the width direction C.

For example, the unit body 310 may include a contact frame 311, which is supported on the cassette body 201, and which comes into contact with one end portion of the printing medium loaded on the knock-up plate 210, and a support frame 315 coupled to the contact frame 311 for supporting at least one of the unit hook 320 and the hook releaser 330.

In order to adjust the aligning unit 300 to correspond to the width of the printing medium loaded on the knock-up plate 210, the body hook 202*a* is formed to extend along the width direction C while the aligning unit 300 is configured to reciprocate along the width direction C. If adjustments in the length direction of the printing medium is required, such adjustment in the length direction may be realized by forming the body hook 202*a* to extend along the length direction perpendicular to the width direction C, and by arranging the aligning unit 300 to reciprocate along the length direction.

The contact frame 311 may include a contact portion 311*a* for contacting one end portion of the printing medium and an, extension portion 311*b* extending away from the contact piece 311*a* along the width direction C of the printing medium.

The contact frame 311 contains metal material such as aluminum or the like and may be manufactured by press molding.

The contact frame 311 may be manufactured as a single integral member, or, alternatively, the contact portion 311*a* and the extension portion 311*b* may be manufactured as separate members, and may be joined together, for example, by welding.

Figure 4:
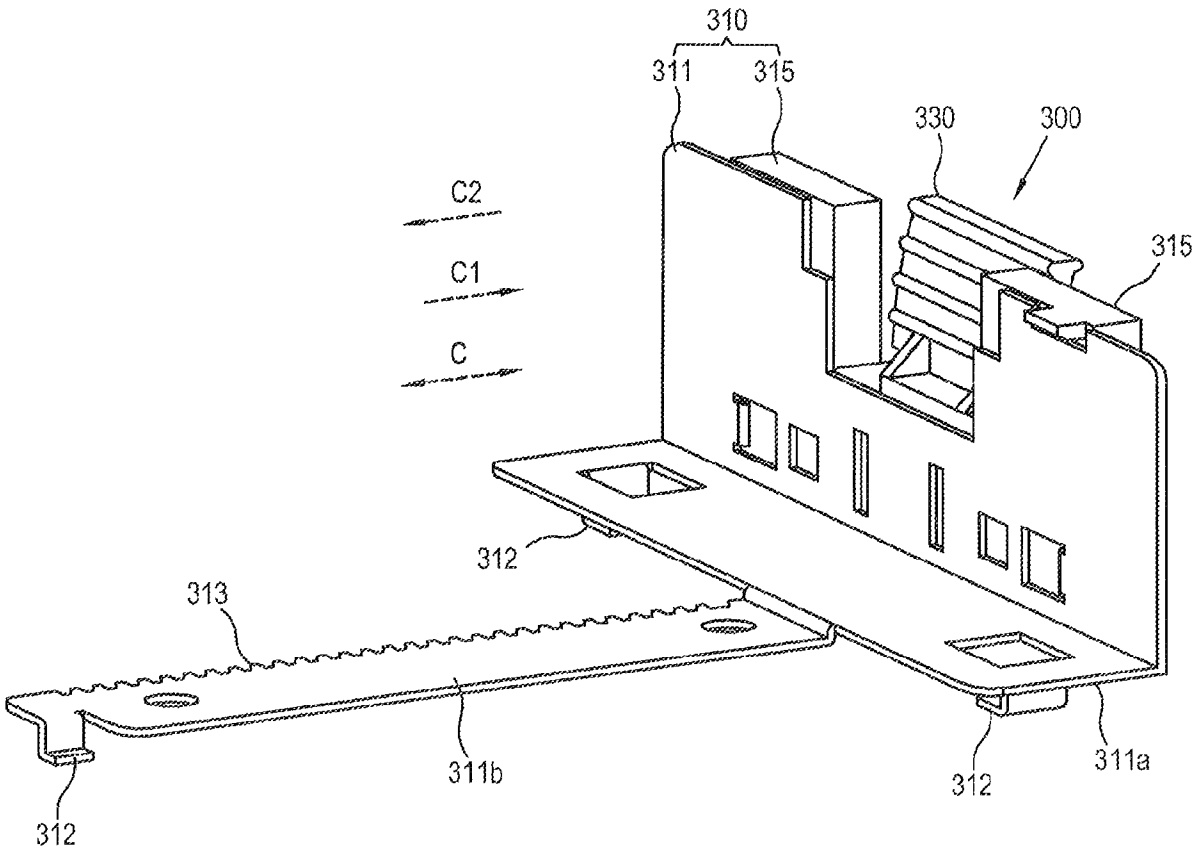
FIG. 4 is an enlarged perspective view of an aligning unit in the printing medium feeding cassette of FIG. 3.
Figure 5:
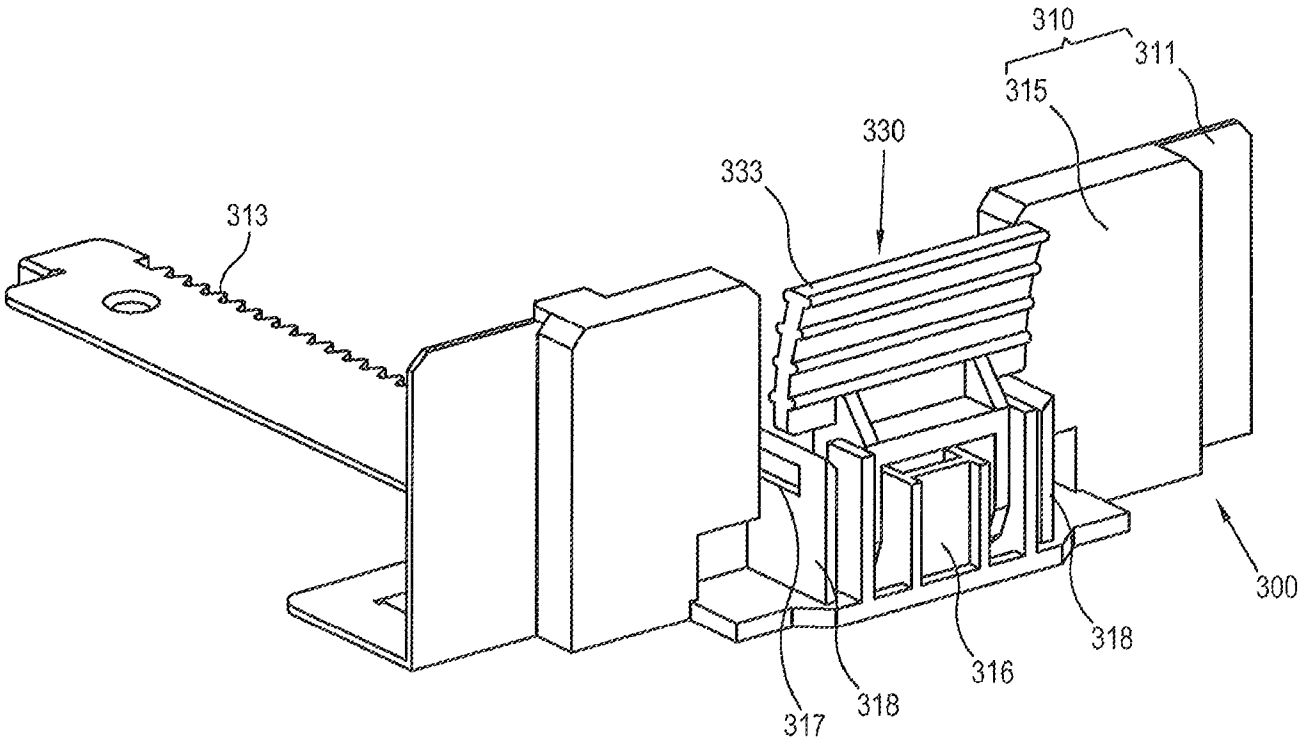
FIG. 5 is an enlarged perspective view of the aligning unit of FIG. 4 viewed from a different direction.

Further, as shown in FIG. 4, one or more separation preventers 312 may be provided at an end portion of the extension portion 311*b*.

The separation preventer 312 may be have a bent shape, for example, an L-like shape, and may be received in the guide groove 203*a* formed in the underlying frame 202 of the cassette body 201. The bent end portions of the separation preventers 312 may thereby be in an engaging contact with the underlying frame 202 of the cassette body 201, preventing the aligning unit 300 from being separated by being lifted upward and away from the cassette body 201.

A width adjusting rack 313 may be formed at one side of the extension portion 311*b* along the width direction C of the printing medium.

The width adjusting rack 313 of the extension portion 311*b* may be engaged with another width adjusting rack 353*a* formed on the extension piece 353 of an auxiliary aligning unit 350 (which will be described in greater detail later) through a pinion 220 (which will be described in greater detail later) interposed between the width adjusting racks, The contact portion 311*a* may have an L-like shape. One or more separation preventers 312 may be provided in the bottom of the contact portion 311*a*. The separation preventers 312 may be provided in a bent shape, for example, an L-like shape, as described above.

The separation preventers 312 provided in the contact portion 311*a* may be received in the guide grooves 203*b* and 203*c* formed in the underlying frame 202, respectively. Accordingly, it is possible to prevent the aligning unit 300 from being separated from the cassette body 201.

While the unit body 310 is described as being composed of a plurality of frames 311 and 315, it should be understood that in alternative embodiments, two or more of the above described frames may be formed integrally, and that the shapes and the material of the frames may be changed in various ways.

As shown in FIG. 3, a printing medium feeding cassette 200 according to an embodiment of the present disclosure may further include the auxiliary aligning unit 350. The auxiliary aligning unit 350 may be used when both ends of the printing medium on the knock-up plate 210 are required to be aligned, that is, to align the printing media to the center of the printing medium feeding cassette 200. If such exact center alignment is not required, the auxiliary aligning unit 350 may be omitted.

The printing medium alignment may be broadly divided into the center feeding type and the side feeding type. The center feeding type requires interlocking aligning units moving relative to the printing medium at both sides of the printing medium since both sides of the printing medium has to be aligned to the center. The side feeding type, on the other hand, may require a movable aligning unit at only one side of the printing medium since the alignment is based on one side of the printing medium. When provided, the auxiliary aligning unit 350 moves in the width direction C of the printing medium in an interlocked manner with respect to the movement of the aligning unit 300.

That is, when the aligning unit 300 moves inwardly along the width direction C, the auxiliary aligning unit 350 also moves inwardly in correspondence with the movement of the aligning unit 300.

To that end, the auxiliary aligning unit 350 may include a contact frame 351 for contacting the other end of the printing medium loaded on the knock-up plate 210 and an extension portion 353 that extends from the contact frame 351 toward the aligning unit 300.

The extension portion 353 and the contact frame 351 may also be provided with separation preventers (not shown), such as the above-described separation preventers 312, to prevent the auxiliary aligning unit 350 from being separated from the cassette body 201.

The extension portion 353 may include a width adjusting rack 353*a* engaged with the pinion 220 to which the width adjusting rack 313 of the aligning unit 300 is also engaged. Accordingly, the auxiliary aligning unit 350 moves in interlocking relation to the movement of the aligning unit 300 so as to supply the printing medium from the knock-up plate 210 into the image forming part 400 according to the afore-mentioned center feeding type. As previously discussed, while the center feeding type is shown in FIG. 3 as an illustrative example, the side feeding type may alternatively be employed, in which case, the auxiliary aligning unit 350 may be omitted.

The support frame 315 of the unit body 310 may be made of, for example, plastic material, and may be formed, for example, by injection molding. It may alternatively be made of various other materials, such as, for example, a metallic material or the like.

The unit hook 320 may selectively engage the body hook 202*a*. The unit hook 320 may be accommodated in a space defined between a guide 316 and the contact frame 311 of the unit body 310, and may be configured to be movable vertically within such space.

The unit hook 320 may include a stopper 325 facing the body hook 202*a*. The stopper 325 may be provided, for example, in a rack shape. It should be understood however that various modification of the shape of the stopper 325 and of the body hook 202*a* can be made as long as selective engagement therebetween can be achieved.

Figure 8:
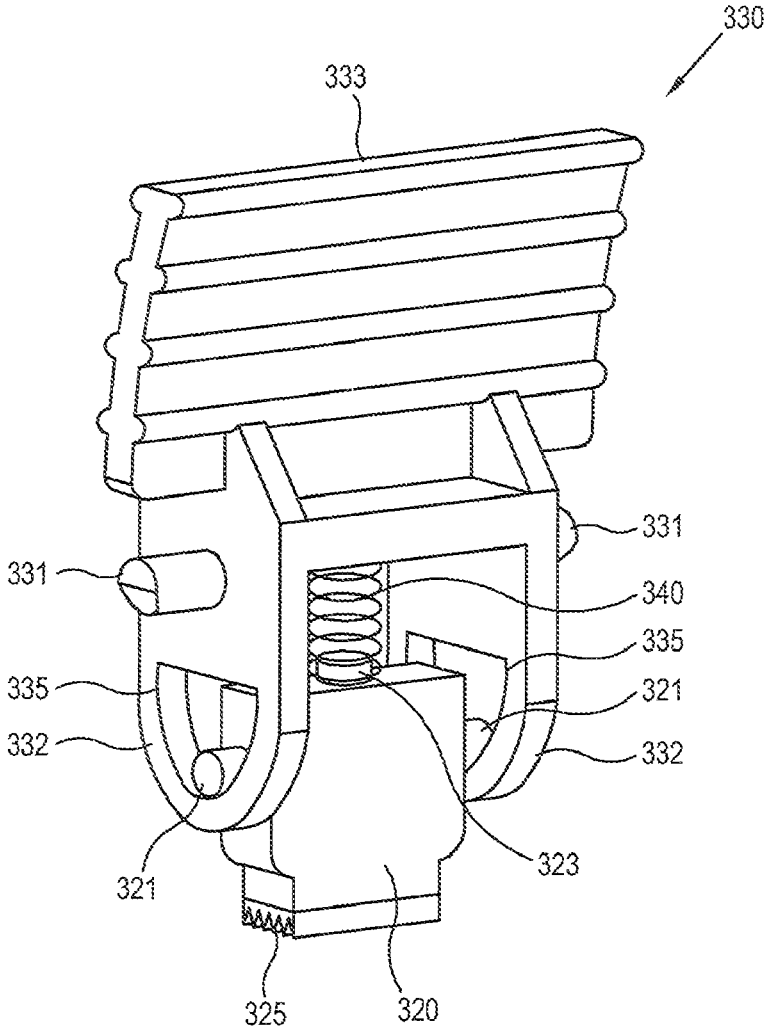
FIG. 8 is an enlarged perspective view of a portion of the aligning unit of FIG. 4.

As shown in FIG. 8, the unit hook 320 may further include a plurality of projections 321 projecting toward a flange 332 of the hook releaser 330, which will be described later; and an elastic member support 323 for supporting an elastic member 340, which will be described later.

The unit hook 320 may become released from the body hook 202*a* when an external force is exerted on the hook releaser 330, and may interact with the hook releaser 330 such that the unit hook 320 is engagingly hooked to the body hook 202*a* when the external force is released. The interaction between the unit hook 320 and the hook releaser 330 will be described in greater detail later.

Referring to FIGS. 4 to 8, the hook releaser 330 may be rotatably supported to the support frame 315 of the unit body 310. That is, the hook releaser 330 may be provided with hinge shafts 331, for example, one on each side, capable of being received in shaft hole(s) 317 formed in the support frame 315. The hook releaser 330 may thus be rotatably supported to the unit body 310.

According to an embodiment, the center point of the hinge shafts 331, which is the rotational center of the hook releaser 330, may be located on the vertical plane defined by the linear motion of the unit hook 320. That is, the centers of the projections 321 of the unit hook 320 and the centers of the hinge shafts 331 may be substantially coplanar in the vertical direction.

According to an embodiment, the shaft hole 317 may be provided in a standing web 318 of the support frame 315 with the hook releaser 330 interposed therebetween. In alternative embodiments however the position and shape of the shaft holes 317 may be modified in various ways as long as they can rotatably support the hook releaser 330.

According to an embodiment, the hook releaser 330 may be formed integrally as a single member.

The hook releaser 330 may include flanges 332 provided on both sides with the unit hook 320 interposed therebetween in such arrangement that allows sufficient space for the movement of the unit hook 320.

The hook releaser 330 may further include a guide 335 provided in the flanges 332 of the hook releaser 330 for guiding the movement of the plurality of projections 321.

According to an embodiment, the guide 335 may be provided as a throughhole-like guide groove 335 as shown in FIG. 8. In alternative embodiments, the guide 335 may be provided to have different configurations, for example, the guide 335 may be provided as projections protruding from the flanges 332 toward the projections 321.

The guide 335 guides the movement of the projections 321 of the unit hook 320 in such a manner allowing changes in the relative position between the unit hook 320 and the hook releaser 330.

The hook releaser 330 may further include an external force receiving portion 333 which receives an external force in the width direction (C in FIG. 4) of the printing medium.

Figure 9:
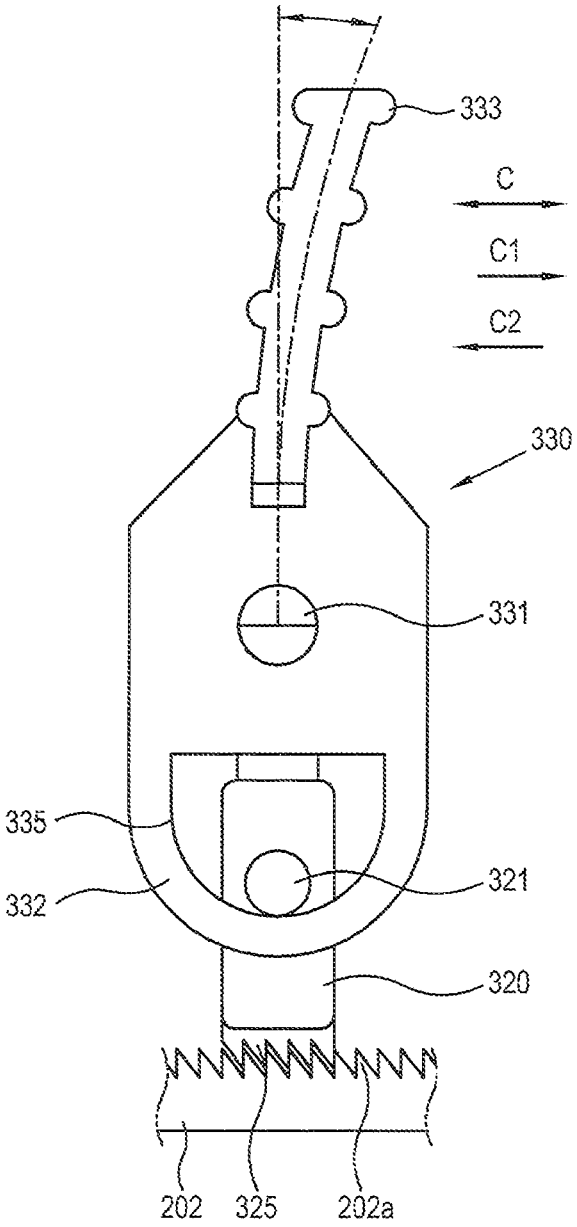
FIG. 9 is an enlarged side view of the portion of the aligning unit shown in FIG. 8.

According to an embodiment, as shown in FIG. 9, an end portion of the external force receiving portion 333 may be inclined outwardly from the central line connecting the respective centers of the hinge shafts 331 of the hook releaser 330 and the projections 321 of the unit hook 320. With such inclined configuration, even when a user exerts a pushing force (F1 in FIG. 10A) on the external receiving portion 333, that is, the hook releaser 330, the external force receiving portion 333 may not interfere with the printing medium loaded on the knock-up plate 210.

As referred to herein, the pushing force (F1 in FIG. 10A) is defined as the force exerted in the direction away from the front side G of the image forming apparatus (100 in FIG. 1) whereas the pulling force (F2 in FIG. 10B) is defined as the force exerted in the direction toward the front side G.

According to an embodiment, the hook releaser 330 may be integrally formed of, for example, plastic material by, for example, injection molding.

As shown in FIG. 8, the aligning unit 300 according to an embodiment may further include an elastic member 340 interposed between the unit hook 320 and the hook releaser 330.

When provided, the elastic member 340 elastically biases the unit hook 320 away from the hook releaser 330.

Figure 10A:
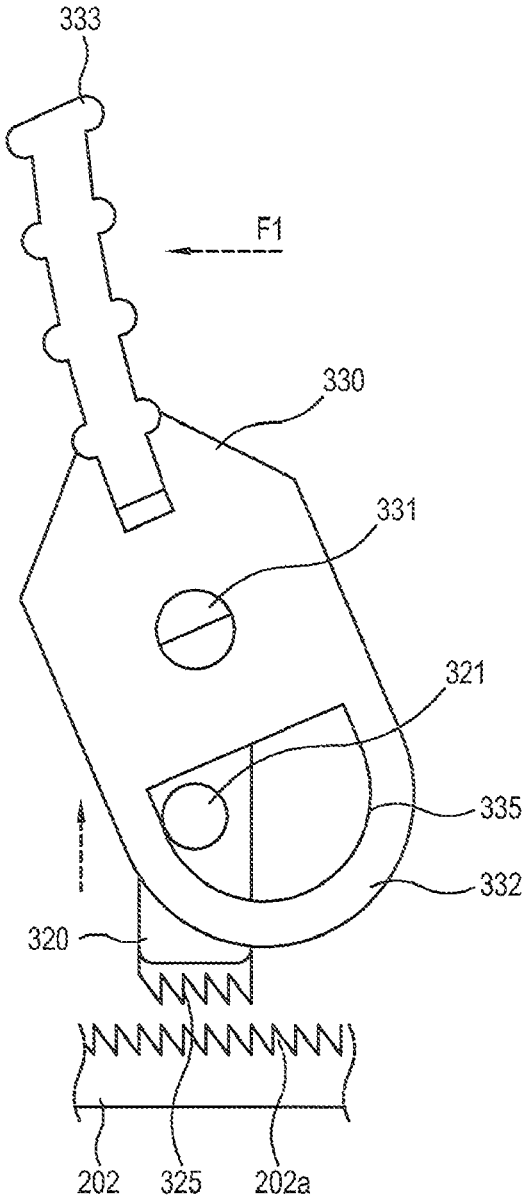
FIGS. 10A and 10B are side views illustrating the operational state of the aligning unit of FIG. 9 when a pushing force is exerted on the aligning unit and when an opposite pulling force is exerted on the aligning unit, respectively.
Figure 10B:
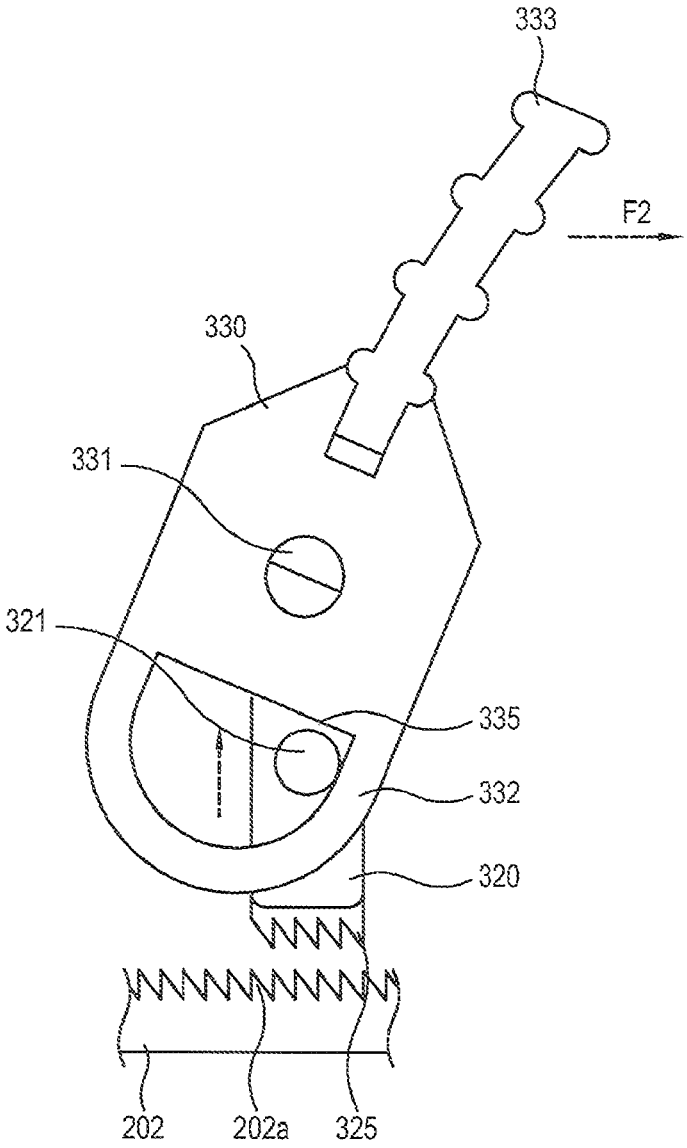

Referring now to FIGS. 9 to 10B, the interactions between the unit hook 320 and the hook releaser 330 of the aligning unit 300 in response to the pushing force (F1) and to the opposing pulling force (F2) will be described.

As shown in FIG. 9, with no external force exerted on the hook releaser 330, the unit hook 320 is positioned away from the hook releaser 330. Accordingly, the stopper 325 provided in the bottom of the unit hook 320 is in engagement with the body hook 202*a* formed in the underlying frame 202 of the cassette body 201 so as to prevent the movement of the aligning unit 300. Accordingly, the aligning unit 300 maintains the current position that may have been previously set. The position of the unit hook 320 shown in FIG. 9 corresponds to the engaged position.

As shown in FIG. 10A, when the user exerts a pushing force (F1) on the external force receiving portion 333 of the hook releaser 330, causing the hook releaser 330 to rotate counter-clockwise about the hinge shafts 331. As the hook releaser 330 so rotates, the projections 321 of the unit hook 320 being guided by the guide 335 move upwardly toward the hinge shaft 321. As a result the unit hook 320 also moves upwardly along with the projections 321, resulting in the stopper 325 being disengaged or released from the body hook 202*a*. The position of the unit hook 320 shown in FIG. 10A corresponds to the first released position.

Accordingly, with the above described configuration, when the user pushes on the hook releaser 330, the unit hook 320 becomes released from the body hook, thereby allowing the user to adjust the position of the aligning unit 300. In this case, with the unit hook 320 in the first released position, the user is able to adjust the position of the aligning unit 300 in the direction of decreasing the width of the printing media with the same continuous pushing motion.

On the other hand, from the state shown in FIG. 9, when a pulling force (F2) is exerted on the external force receiving portion 333 of the hook releaser 330, that is, when the hook releaser 330 is pulled, as shown in FIG. 10B, the hook releaser 330 rotates clockwise about the hinge shafts 331 as a result. As the hook releaser 330 so rotates, the projections 321 of the unit hook 320 being guided by the guide 335 move upwardly toward the hinge shaft 321. The unit hook 320 also moves upwardly along with the projections 321, resulting in the stopper 325 being released from the body hook 202*a*. The position of the unit hook 320 shown in FIG. 10B corresponds to the second released position.

Accordingly, the unit hook 320 also becomes released from the body hook 202*a* in response to the user pulling on the hook releaser 330, thereby allowing the user to adjust the position of the aligning unit 300. In this case, with the unit hook 320 in the second released position, the user is able to adjust the position of the aligning unit 300 in the direction of increasing the width of the printing media with the same continuous pulling motion.

When the user releases the external force receiving portion 333, the unit hook 320 automatically returns to the engaged position shown in FIG. 9 by the elastic force of the elastic member (340 in FIG. 8).

With the above-configured printing medium feeding cassette 200, and thus with image forming apparatus 100 incorporating the same, a more convenient and intuitive adjustment for the variation of the printing media loaded on the knock-up plate 210 with a simple pulling or pushing on the external force receiving portion 333 by the user.

In addition, as the hook releaser 330 is allowed to be released with either of the bidirectional movement thereof into the first or the second released positions as described above, the likelihood of the user exerting an excessive force in an attempt to release the adjustment mechanism that may damage the mechanism, thereby improving user convenience.

In addition, during when the width adjustment is being made, as the same adjustment motion ensures the unit hook 320 to be released from the body hook 202*a*, there occurs no noise due to the contact between the unit hook 320 and the body hook 202*a*.

Figure 11A:
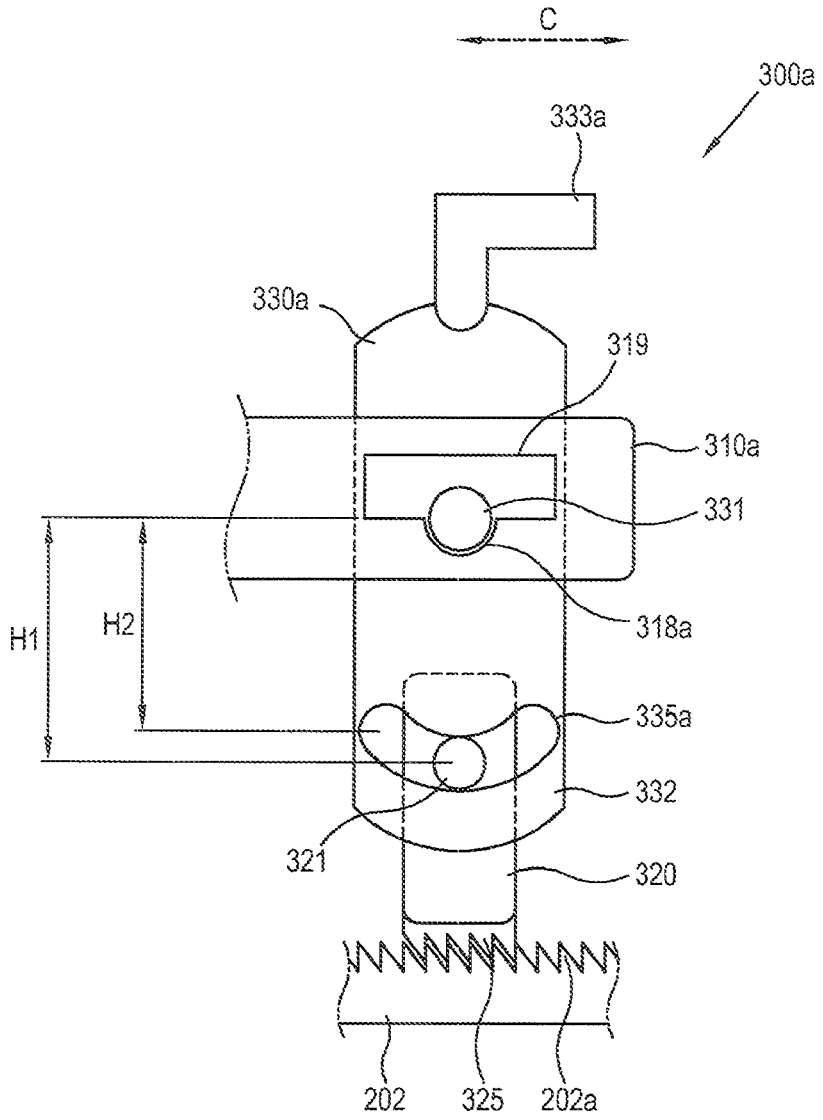
FIGS. 11A to 11C are side views of an aligning unit in a printing medium feeding cassette when no external force is exerted on the aligning unit, when a pushing force is exerted on the aligning unit, and when a pulling force is exerted on the aligning unit, respectively, according another embodiment of the present disclosure.
Figure 11B:
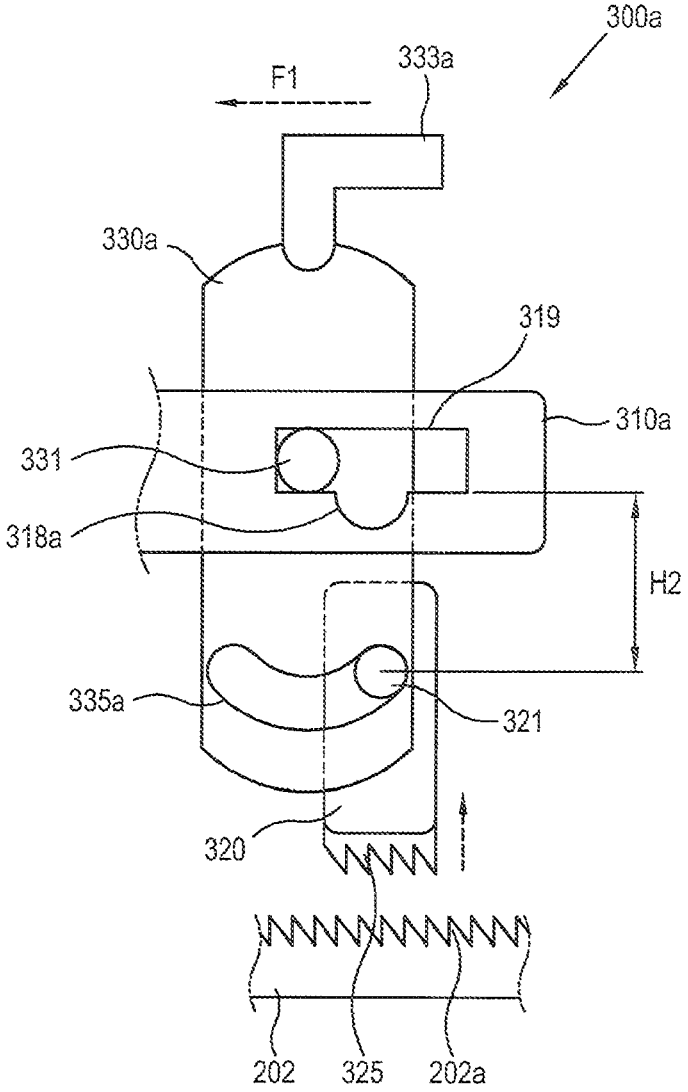
Figure 11C:
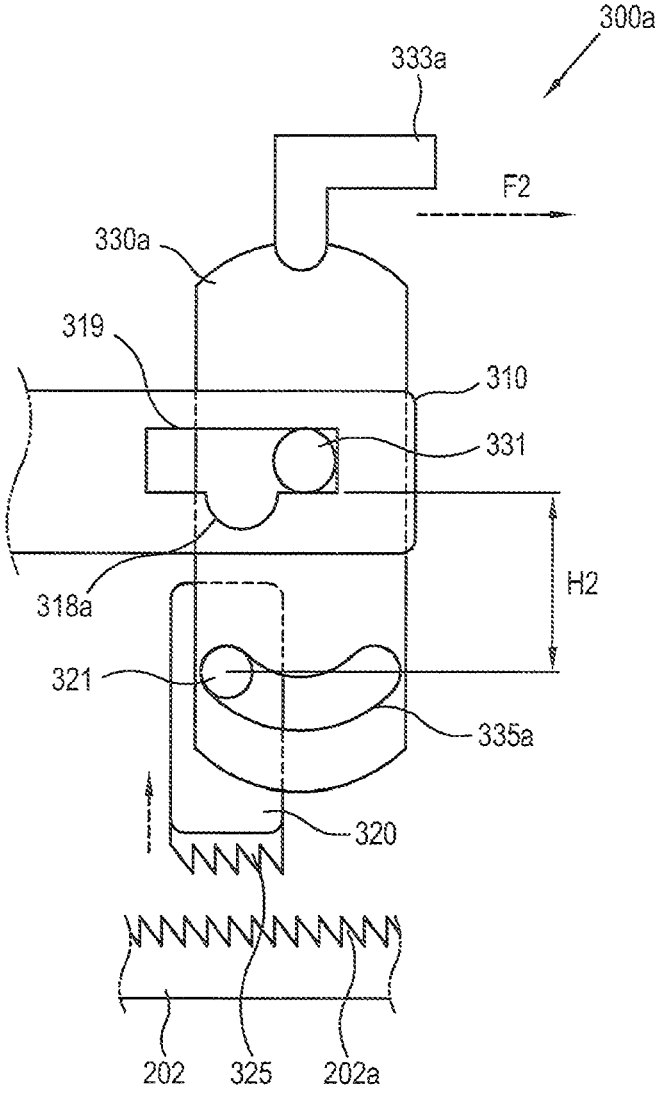

Referring now to FIGS. 11A to 11C, an aligning unit 300*a* according to another embodiment of the present disclosure will be described.

Aspects of a printing medium feeding cassette according to this embodiment may have substantially the same configuration, and may function as, the printing medium feeding cassette according to those embodiments that have been previously described. Thus, those elements of previously described embodiments that are also incorporated in the embodiments shown in FIGS. 11A to 11C are denoted by the same reference numerals, and for brevity sake the descriptions thereof will not be repeated.

As shown in FIG. 11A, the aligning unit 300*a* according to an embodiment may include a unit body 310*a*, a unit hook 320 and a hook releaser 330*a*.

The unit body 310*a* may include a sliding groove 318 extending in the width direction C of the printing medium.

A hinge shaft 331 of the hook releaser 330*a* may be received in the sliding groove 318. Accordingly, the hook releaser 330*a* is supported to the unit body 310*a* such that the hook releaser 330*a* is capable of slidably reciprocate along the width direction C of the printing medium with respect to the sliding motion center 318*a*.

The hook releaser 330*a* may include an external force receiving portion 333*a* and a guide 335*a* for guiding the movement of the projection 321 of the unit hook 320.

Without an external force being exerted on the external force receiving portion 333*a* of the hook releaser 330*a*, the unit hook 320 is at the hooking position, as shown in FIG. 11A. Accordingly, the unit hook 320 is hooked to the body hook 202*a*, thereby regulating movement of the aligning unit 300*a* so that the aligning unit 300 maintains the current position, which may have been previously set. The position of the unit hook 320 shown in FIG. 11A thus correspond to the engaged position.

On the other hand, as shown in FIG. 11B, when a pushing force (F1) is exerted on the external force receiving portion 333*a*, the hook releaser 330*a* slidably moves along the sliding groove 318 in the direction of the pushing force (F1). Accordingly, the projection 321 of the unit hook 320 is guided by the guide 335*a* to rise upward. As the unit hook 320 rises, the stopper 325 formed in the bottom of the unit hook 320 is released from the body hook 202*a*. The position of the unit hook 320 shown in FIG. 11B corresponds to the above-mentioned first released position.

As shown in FIG. 11C, when a pulling force (F2) is exerted on the external force receiving portion 333*a*, the hook releaser 330*a* slidably moves along the sliding groove 318 in the direction of the pulling force (F2). Accordingly, the projection 321 of the unit hook 320 is again guided by the guide 335*a* to thereby rise upward. As the unit hook 320 rises, the stopper 325 formed in the bottom of the unit hook 320 becomes released from the body hook 202*a*. The position of the unit hook 320 shown in FIG. 11C corresponds to the above-mentioned second released position.

As shown FIGS. 11A to 11C, the distance (H1) from the lower surface of the sliding groove 318 to the center of the projection 321 at the engaged position is lager than the distance (H2) from the lower surface of the sliding groove 318 to the center of the projection 321 at the first or second released position.

Such difference between the distance (H1) and the distance (H2) is determined in such a manner to ensure that the stopper 325 is released from the body hook 202*a*.

In addition, the aligning unit 300*a* according to an embodiment may further include an elastic member (not shown) allowing the aligning unit 300*a* to return to the engaged position shown in FIG. 11A from the first released position shown in FIG. 11B and the second released position shown in FIG. 11C when the external force exerted on the external force receiving portion 333*a* is released. According to an embodiment, an elastic member (not shown) may be provided to elastically bias the hinge shaft 331 to the sliding center 318*a*, which becomes the balance point as the hinge shaft 331 moves away from the sliding center 318*a* in either direction.

As one illustrative example, the elastic member (not shown) may have one end thereof connected to the hinge shaft 331 while the other end is connected to the sliding center 318*a* so as to exert such an elastic force that biases the hinge shaft 331 to return towards the sliding center 318*a*.

As can be appreciated from the above described embodiments of the present disclosure, when a force is exerted on the hook releaser 330 or 330*a* along the width direction C in either the forward direction or the backward direction, that is, when either the puling force (F2) or the pushing force (F1) is exerted on the hook releaser 330 or 330*a*, the unit hook 320 interacts with the body hook 202*a* in such a manner that the unit hook 320 is released from the body hook 202*a*. For example, in the above described embodiments, the alignment unit 300 or 300*a* is arranged such that, as the unit hook 320 approaches the hook releaser 330 or 330*a*, the unit hook 320 is released from the body hook 202*a*.

Accordingly, a user can handle the aligning unit 300 or 300*a* more conveniently and intuitively.

Moreover, since the unit hook 320 is sufficiently separated from the body hook 202*a* during the movement of the aligning unit 300 or 300*a*, less noise occurs, allowing a quieter adjustment of the alignment unit.

While in the hitherto illustrated embodiments the aligning units that are movable in the widthwise direction of the printing media to thereby provide the adjustment for different widths of the printing media being used, it should be understood that an aligning unit having the configuration according to one or more aspects of the present disclosure, such as, for example, the aligning unit 300 or 300*a*, may utilized for adjustment in other dimensions, such as for example, in the lengthwise direction by arranging such aligning unit to be moveable along the length direction of the printing media. In addition, it is within the contemplation of the present disclosure that a plurality of aligning units, for example, movable along the width and length directions of the printing media may be provided to allow adjustments in both the widthwise and lengthwise directions.

While several embodiments of the present disclosure have been shown and described in particular detail, it will be appreciated by those skilled in the art that various changes may be made to these embodiments without departing from the principles and spirit of the invention, the scope of which is defined in the appended claims and their equivalents.

What is claimed is:

1. An image forming apparatus comprising:

a body including an image forming part to form an image on a printing medium; and a printing medium feeding cassette including a cassette body, a knock-up plate supported in the cassette body for supporting printing media, and an aligning unit for aligning printing media loaded on the knock-up plate, the aligning unit having a force receiving portion and a first engaging portion movable by the force receiving portion to releasably engage with a second engaging portion of the cassette body, wherein, when a push force is applied in a first adjustment direction to the force receiving portion to move the aligning unit in the first adjustment direction, the force receiving portion rotates about a single fulcrum and moves the first engaging portion upward with respect to and towards the single fulcrum by the rotation of the force receiving portion causing the first engaging portion to be released from the second engaging portion, and wherein, when a pull force is applied in a second adjustment direction which is opposite to the first adjustment direction to the force receiving portion to move the aligning unit in the second adjustment direction, the force receiving portion rotates about the single fulcrum and moves the first engaging portion upward with respect to and towards the single fulcrum by the rotation of the force receiving portion causing the first engaging portion to be released from the second engaging portion.

2. The image forming apparatus of claim 1, wherein the aligning unit comprises a support frame and the force receiving portion is rotatably mounted to the support frame, wherein, when the push force is applied on the force receiving portion, the push force causes the force receiving portion to rotate with respect to the support frame.

3. The image forming apparatus of claim 1, wherein the aligning unit comprises a support frame and the force receiving portion is rotatably mounted to the support frame, wherein, when the pull force is applied on the force receiving portion, the pull force causes the force receiving portion to rotate with respect to the support frame.

4. The image forming apparatus according to claim 1, wherein the second engaging portion comprises a body hook formed along the first and second adjustment directions, the first and second adjustment directions both being a same one of either a width direction and a length direction of the printing media, the first engaging portion comprises a unit hook configured to selectively come into an engaging contact with the body hook, and the force receiving portion comprises a hook releaser to receive the push force or the pull force and to cause the unit hook to be released from the body hook in response to the applied push force or the applied pull force.

5. The image forming apparatus according to claim 4, further comprising an elastic member that elastically biases the unit hook such that the unit hook returns to the engaged position when the push force or the pull force is no longer applied to the force receiving portion.

6. A printing medium feeding cassette for accommodating printing media for use in an image forming apparatus, comprising:

a cassette body having arranged therein a body hook formed along an adjustment direction, the adjustment direction being one of a width direction and a length direction of the printing media;

a knock-up plate supported in the cassette body, the knock-up plate having a surface for supporting thereon the printing media; and an aligning unit supported on the cassette body for aligning the printing media loaded on the knock-up plate, the aligning unit having a unit body, a unit hook configured to selectively come into an engaging contact with the body hook and a hook releaser coupled to the unit body, the hook releaser being configured to receive a force and to cause the unit hook to be released from the body hook in response to the force received in each of a pulling direction and a pushing direction, wherein the hook releaser is adapted to rotate about a single fulcrum when the hook releaser receives the force, and the unit hook moves upward with respect to and towards the single fulcrum to be released from the body hook during the rotation of the hook releaser.

7. The printing medium feeding cassette according to claim 6, wherein the hook releaser is configured to cause the unit hook to move to one of a first position and a second position, such that the unit hook is in a released position to be released from the body hook in the first position when the force is exerted on the hook releaser, and the unit hook is in an engaged position to be engaged with the body hook in the second position when the force is released from the hook releaser.

8. The printing medium feeding cassette according to claim 7, further comprising an elastic member that elastically biases the unit hook such that the unit hook returns to the engaged position when the force is released.

9. The printing medium feeding cassette according to claim 7, wherein the unit hook includes a projection projecting toward the hook releaser, and wherein the hook releaser includes a guide which guides movement of the projection.

10. The printing medium feeding cassette according to claim 9, wherein the guide includes a guide groove configured to guide the movement of the projection between the first released position, the engaged position and the second released position.

11. The printing medium feeding cassette according to claim 7, wherein the hook releaser is rotatably coupled to the unit body, and wherein the unit hook approaches the single fulcrum to move to the first and second released positions, and moves away from the single fulcrum to move to the engaged position.

12. The printing medium feeding cassette according to claim 11, wherein the unit hook reciprocates linearly.

13. The printing medium feeding cassette according to claim 11, wherein the single fulcrum is located on a plane along which the unit hook linearly moves.

14. The printing medium feeding cassette according to claim 7, wherein the hook releaser is coupled to the unit body such that the hook releaser reciprocates slidably with respect to a sliding motion center, and wherein the unit hook approaches the sliding motion center to move between the first position and second position.

15. The printing medium feeding cassette according to claim 6, wherein the hook releaser includes a force receiving portion configured to receive the force, an end portion of the force receiving portion being outwardly inclined with respect to a vertical center of the hook releaser.

16. An apparatus for guiding at least one edge of a printing medium being fed into an image forming apparatus, comprising:

a print media accommodation unit having a support surface for placing thereon the printing medium;

a contact frame moveable in a first adjustment direction toward the at least one edge of the printing medium supported on the support surface and in a second adjustment direction away from the at least one edge of the printing medium;

an engagement member configured to selectively engage with a portion of the print media accommodation unit to thereby restrict a movement of the contact frame; and an engagement releaser member coupled to the engagement member, the engagement releaser member being configured to cause the engagement member to be released from the portion of the print media accommodation unit in response to a force received in the first adjustment direction and in the second adjustment direction, wherein the engagement releaser member is adapted to rotate about a single fulcrum in response to the received force and the engagement member moves upward with respect to and towards the single fulcrum and in response to the rotation of the engagement releaser member.

17. The apparatus according to claim 16, wherein the engagement releaser member having formed thereon a guide that guides the engagement member to move along a direction substantially perpendicular to the first and second adjustment directions during the rotation of the engagement releaser member in response to the received force.

18. The apparatus according to claim 16, wherein the engagement releaser member is configured to slide linearly along a direction substantially parallel to the first and second adjustment directions in response to the received external force.

19. An image forming apparatus, comprising:

a body including an image forming part to form an image on a printing medium; and a printing medium feeding cassette including a cassette body, a knock-up plate supported in the cassette body for supporting printing media, and an aligning unit for aligning printing media loaded on the knock-up plate, the aligning unit having a force receiving portion and a first engaging portion movable by the force receiving portion to releasably engage with a second engaging portion of the cassette body, wherein, when a push force is applied in a first adjustment direction to the force receiving portion to move the aligning unit in the first adjustment direction, the force receiving portion rotates about a single fulcrum and moves the first engaging portion upward with respect to and towards the single fulcrum by the rotation of the force receiving portion causing the first engaging portion to be released from the second engaging portion, and wherein, when a pull force is applied in a second adjustment direction which is opposite to the first adjustment direction to the force receiving portion to move the aligning unit in the second adjustment direction, the force receiving portion rotates about the single fulcrum and moves the first engaging portion upward with respect to and towards the single fulcrum by the rotation of the force receiving portion causing the first engaging portion to be released from the second engaging portion, and the first engaging portion reciprocates linearly according to rotation of the force receiving portion about the single fulcrum.

* * * * *

UNITED STATES PATENT AND TRADEMARK OFFICE

CERTIFICATE OF CORRECTION

PATENT NO. : 8,882,377 B2
APPLICATION NO. : 12/794483
DATED : November 11, 2014
INVENTOR(S) : Sin-Ae Kim et al.

It is certified that error appears in the above-identified patent and that said Letters Patent is hereby corrected as shown below:

In the claims

Col. 15, line 4, in Claim 10, delete "released" and delete "the engaged position".

Col. 15, line 5, in Claim 10, delete "released".

Col. 15, line 10, in Claim 11, delete "first and second released positions," and insert --released position-- therefor.

Signed and Sealed this
Ninth Day of August, 2016

Michelle K. Lee

Michelle K. Lee
*Director of the United States Patent and Trademark Office*